US005175585A

United States Patent [19]

Matsubayashi et al.

[11] Patent Number: 5,175,585

[45] Date of Patent: Dec. 29, 1992

[54] ELECTROPHOTOGRAPHIC COPIER HAVING IMAGE DENSITY CONTROL

[75] Inventors: Shigeaki Matsubayashi, Sakai; Osamu Ito, Kadoma, both of Japan

[73] Assignee: Matsushita Electric Industrial Co., Ltd., Kadoma, Japan

[21] Appl. No.: 736,441

[22] Filed: Jul. 29, 1991

[30] Foreign Application Priority Data

Jul. 30, 1990 [JP] Japan ..... 2-202180

[51] Int. Cl.[5] ..... G03G 21/00

[52] U.S. Cl. ..... 355/208; 355/207; 355/246; 395/10

[58] Field of Search ..... 355/208, 246, 204, 200, 355/203, 207; 364/148, 149, 150, 151, 152, 164, 165; 395/10

[56] References Cited

U.S. PATENT DOCUMENTS

| | | | |
|---|---|---|---|
| 3,934,124 | 1/1976 | Gabriel | 235/150.1 |
| 4,277,162 | 7/1981 | Kasahara et al. | 355/208 |
| 4,639,853 | 1/1987 | Rake et al. | 364/149 |
| 4,825,055 | 4/1989 | Pollock | 364/164 X |
| 4,975,747 | 12/1990 | Higuchi | 355/246 |
| 5,025,499 | 6/1991 | Inoue et al. | 364/165 |
| 5,029,314 | 7/1991 | Katsumi et al. | 355/208 |
| 5,045,883 | 9/1991 | Ishigaki et al. | 355/246 X |
| 5,053,815 | 10/1991 | Wendell | 355/208 |

FOREIGN PATENT DOCUMENTS 48-72262 6/1973 Japan .

*Primary Examiner*—A. T. Grimley
*Assistant Examiner*—Christopher Horgan
*Attorney, Agent, or Firm*—Cushman, Darby & Cushman

[57] ABSTRACT

In an adaptive control electrophotographic apparatus, input voltages such as illumination power source voltage and electrostatic charge voltage are varied by a small value, and a resultant density of toner image on a photoconductive substance is detected. Then the above-mentioned small value is changed on the basis of a difference between the resultant density and a target density. After several repetitions of the above, the small value is determined on the basis of a qualitative model which is composed of a boundary function including the input voltages and boundary parameters of the apparatus. If the trend in the difference between the resultant density and the target density is an increase, the qualitative mode is changed to effect a decreasing trend.

6 Claims, 6 Drawing Sheets

ELECTROPHOTOGRAPHIC COPIER HAVING IMAGE DENSITY CONTROL

FIELD OF THE INVENTION AND RELATED ART STATEMENT

1. Field of the Invention

The present invention relates generally to a control system, and more particularly to an adaptive control system for controlling an electrophotographic apparatus in which relation between input data and output data is automatically selected from a plurality of data so as to realize the most preferable operation in the electrophotographic apparatus.

2. Description of the Prior Art

A copy machine utilizing electrophotographic method in the prior art is shown in Japanese patent 908 279 and U.S. Pat. No. 4,277,162, for example. According to the Japanese patent 908 279, the surface potential of an electrostatic latent image formed on a part of a drum having photoconductive material is measured by a surface potential detector. Subsequently, a predetermined part of the surface of the photoconductive drum is charged with the potential which is identical with the measured surface potential. Then toner is put on the predetermined part through developing process in a manner which is well known in the art. The toner density of the predetermined part is measured by a density sensor, and supply of toner to the developing device of the copy machine is controlled on the basis of the measured density of the predetermined part.

On the other hand, in the prior art of U.S. Pat. No. 4,277,162, toner density on a copied paper is measured by a density sensor, and a "transfer voltage" which is applied to a transfer member for holding a copy paper to be transferred is controlled on the basis of the measured toner density.

In the above-mentioned density control systems on the electrophotographic copy machines in the prior art, copy density on the copied paper is uniformly varied in compliance with the variation of the supply of toner and the transfer voltage. In other words, a low density part and a high density part of the copied paper are varied in density with the same variation, and "contrast" between the low density part and the high density part is substantially held on a constant value. Consequently, if an operator intends to bring the density into a higher value, "fog" arises on a white ground of the copy paper. In general, the contrast is preferably as high as possible without the "fog".

The present invention is in connection with a patent application by the common assignee and inventors having the application number of Ser. No. 07/643,589 and the title of "adaptive control system", filed with United States Patent and Trademark Office on Jan. 22, 1991.

OBJECT AND SUMMARY OF THE INVENTION

An object of the present invention is to provide an adaptive control electrophotographic apparatus which is controlled in copy density in a manner that the density range of a resultant copy is in coincidence with that of a manuscript or original.

The adaptive control electrophotographic apparatus in accordance with the present invention comprises:

charging means for charging a photoconductive substance of the electrophotographic apparatus with a predetermined voltage of static electricity, exposing means for forming latent image of static electricity of a reference mark on the photoconductive substance by applying light emitted from light emitting means activated by an input voltage and reflected from the reference mark, developer means for generating visible image of the latent image on the photoconductive substance by supplying toner which is biased by a predetermined developer bias voltages, density sensor means for detecting density of the visible image of the reference mark formed on the photoconductive substance, input variation vector generating means for generating a plurality of input variation vectors for varying the voltage of static electricity, the input voltage and the developer bias voltage applied to the electrophotographic apparatus to be controlled, qualitative model calculation means for outputting predictive sign data by applying calculation to the input variation vector on the basis of a predetermined qualitative model, error sign detection means for detecting the sign of a difference between an aimed density value and the detected value of the density sensor means, an input variation vector selection circuit for selecting an input variation vector on the basis of the output of the error sign detection means and the predictive sign data, output sign detecting means for detecting a predetermined sign for representing variation of output value of the electrophotographic apparatus to be controlled, input vector renewal means for adding the selected input variation vector to the voltage of static electricity, the input voltage and the developer bias voltage of the electrophotographic apparatus to be controlled, and qualitative model correction means for correcting the qualitative model on the basis of the input of the electrophotographic apparatus to be controlled and the output detected by the output sign detecting means.

While the novel features of the invention are set forth particularly in the appended claims, the invention, both as to organization and content, will be better understood and appreciated, along with other objects and features thereof, from the following detailed description taken in conjunction with the drawings.

It will be recognized that some or all of the Figures are schematic representations for purposes of illustration and do not necessarily depict the actual relative sizes or locations of the elements shown.

DESCRIPTION OF THE PREFERRED EMBODIMENT

Figure 1:
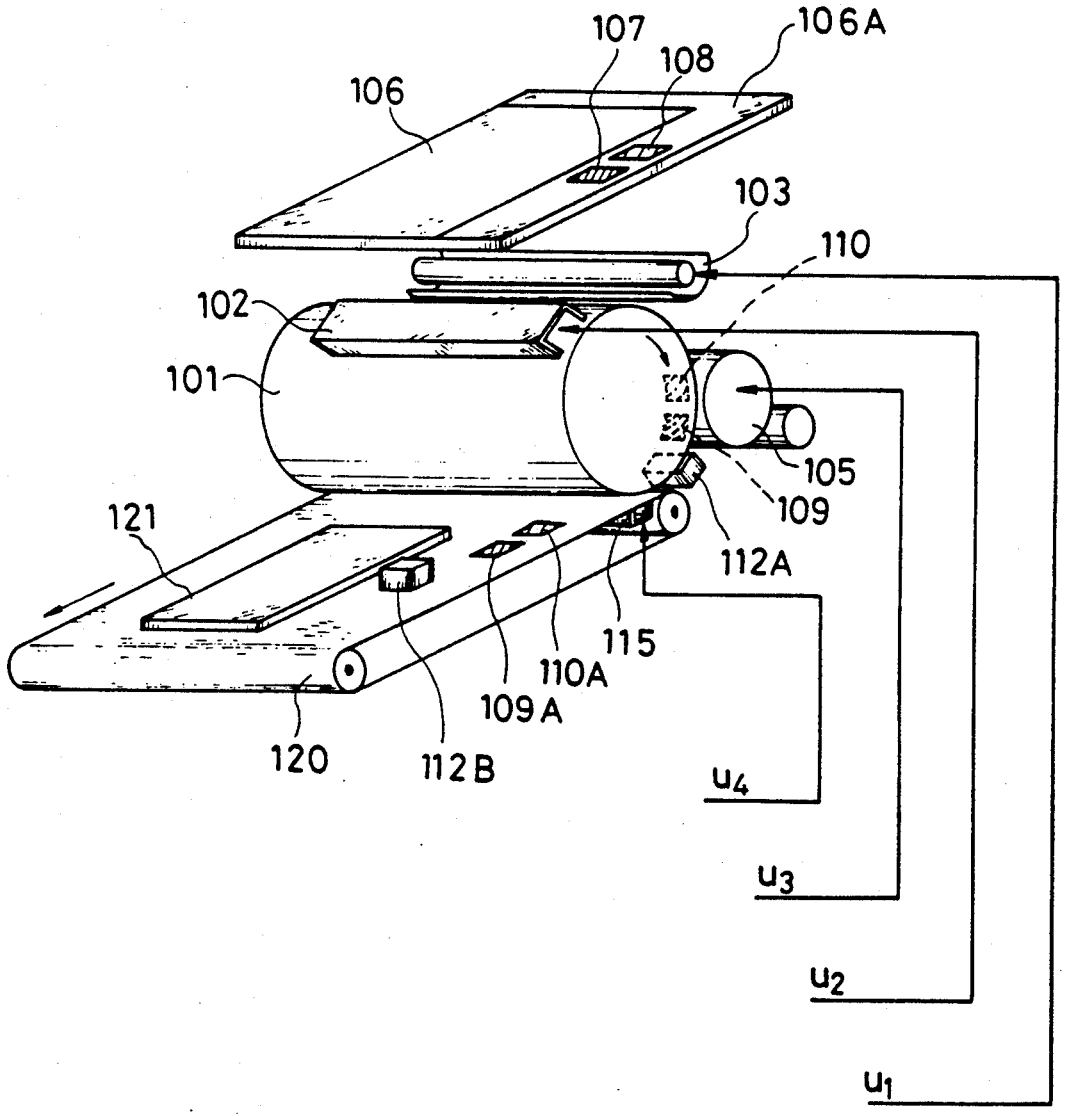
FIG. 1 is a perspective view of an electrophotographic apparatus in accordance with the present invention.

FIG. 1 is a perspective view of a main part of an electrophotographic apparatus. A drum 101 having photoconductive substance on the surface thereof is rotated by a driving means (not shown). A charging unit 102 is disposed adjacent to the surface of the drum 101. An illumination light source 103 for exposing the photoconductive substance is placed under a manuscript holder 106A for holding a manuscript 106 to be copied. The image of the manuscript 106 is focused on the surface of the drum 101 by an optical system (not shown) in a manner known in the art. A developing unit 105 is disposed adjacent to the drum 101.

A first reference mark 107 and a second reference mark 108 are disposed on the manuscript holder 106A. The density of the first reference mark 107 is represented by "$D_{IN.H}$" and the density of the second reference mark 108 is represented by "$D_{IN.L}$". The density $D_{IN.H}$ is larger than the density $D_{IN.L}$. A density sensor 112A is disposed under the drum at an end part thereof, and detects densities of toner images 109 and 110 formed on the drum 101 by the first and the second reference marks 107 and 108 in a manner which is obvious to one skilled in the art. The output of the density sensor 112A (or 112B) is automatically calibrated prior to start of operation in a manner that the density sensor 112A (or 112B) detects the surface of the drum 101 (or transfer belt 120) on which no toner is adhered.

In operation of the electrophotographic apparatus shown in FIG. 1, a "charge voltage $u_2$" is applied to the charging unit 102, and the photoconductive substance on the drum 101 is charged with static electricity. The illumination light source 103 is activated by an electric power of an "input voltage $u_1$" and illuminates the manuscript 106 and the first and the second reference marks 107 and 108. The images of the manuscript 106 and the reference marks 107 and 108 are focused on the drum 101 by the optical system. Consequently, the static electricity on the drum 101 is partially reduced in compliance with the images of the manuscript 106 and the reference marks 107 and 108, and a latent image of an electric potential is formed.

Subsequently, toner is attached to a part of the latent image of the electric potential by the developing unit 105 to which a "developer bias voltage $u_3$" is applied, and toner images 109 and 110 are formed on the drum 101.

The above-mentioned operation is represented by quantitative relation of equations (1), (2) and (3). (These equations are described in the document of "Imaging Processes and Materials" by J. M. Sturge, published by Van Nostrund Reinhold in 1989, pp. 135-180).

$$\log_{10}(E) = \log_{10}(p_1 \cdot u_1) - D_{IN}, \quad (1)$$

$$V = \{\sqrt{(p_2 \cdot u_2)} - p_3 \cdot E\}^2, \quad (2)$$

$$D_{OUT} = p_4(V - u_3), \quad (3)$$

where, $D_{IN}$: "input density" (high input density $D_{IN.H}$ of the first mark 107 or low input density $D_{IN.L}$ of the second mark 108, for example), $D_{OUT}$: "output density" (high output density $D_{OUT.H}$ of toner image 109 of the first mark 107 or lows output density $D_{OUT.L}$ of the toner image 110 of the second mark 108 on the drum 101, for example), E: "light energy" dependent upon reflected light from first and second marks 107 and 108, the light energy corresponds to the input density $D_{IN}$, V: surface potential of the drum 101, the surface potential is reduced by the light energy E, $p_1$: positive parameter dependent upon the characteristic of the illumination light source 103, $p_2$: postive parameter dependent upon the natural discharge characteristic of the photoconductive substance of the drum 101, $p_0$: positive parameter dependent upon transmission factor of the optical system and photo graphic sensitivity of the photoconductive substance, $p_4$: positive parameter dependent upon the dielectric constant of the photoconductive substance and density of toner of the developing unit 105.

Figure 2:
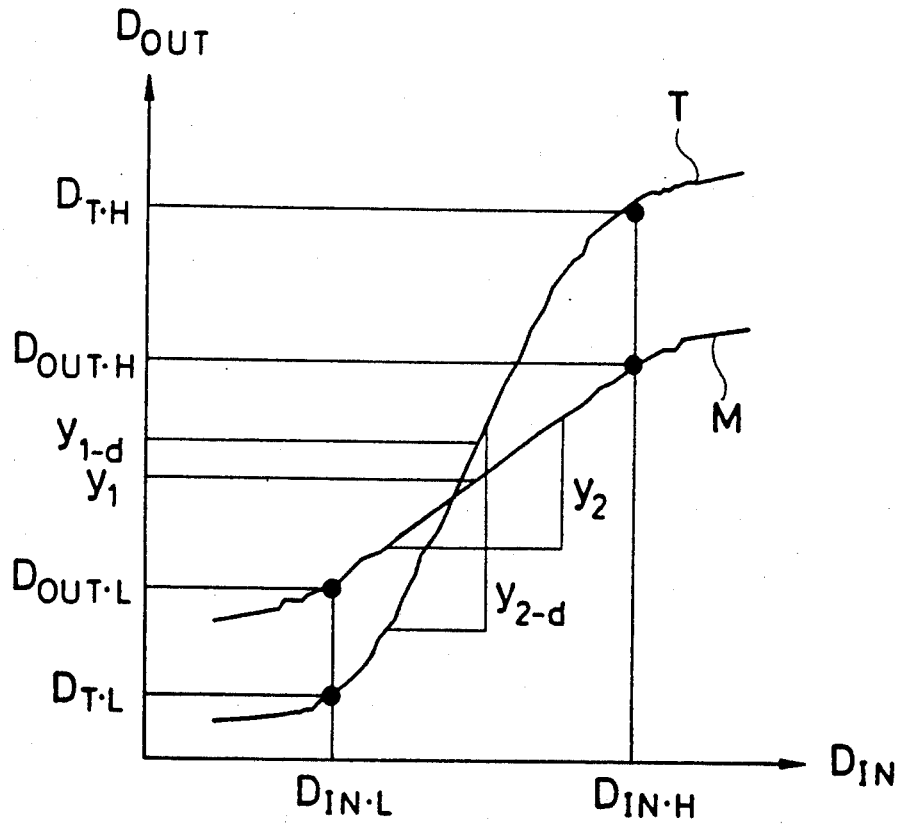
FIG. 2 is a graph of density curves M and T.

Relation between the input density $D_{IN}$ and the output density $D_{OUT}$ calculated by the equations (1), (2) and (3) are shown by "density curves" M and T in FIG. 2. In FIG. 2, abscissa is graduated by the input density $D_{IN}$, and ordinate is graduated by the output density $D_{OUT}$. The density curve M represents the variation of "measured density" of the toner images 109 and 110 of the first and second marks 107 and 108, and the density curve T represents the variation of "target density" thereof. The measured density is represented by a curve connecting between a point ($D_{IN.L}$, $D_{OUT.L}$) and a point ($D_{IN.H}$, $D_{OUT.H}$) which are plotted on the basis of the measured values of the density sensor 112A. The target density is represented by a curve connecting between a point ($D_{IN.L}$, $D_{T.L}$) and a point ($D_{IN.H}$, $D_{T.H}$) which are plotted on the basis of a "desirable high density $D_{T.H}$" and a "desirable low density $D_{T.L}$.

The midpoint value $y_1$ of the density curve M is calculated by relation (4), and the gradient $y_2$ thereof is calculated by relation (5).

$$y_1 = (D_{OUT.H} + D_{OUT.L})/2 \quad (4).$$

$$y_2 = (D_{OUT.H} - D_{OUT.L})/(D_{IN.H} - D_{IN.L}) \quad (5).$$

Subsequently, elements of an input vector U ($=u_1$, $u_2$, $u_3$) and elements of an output vector $Y=(y_1, y_2)$ are represented by the relations 6A and 6B.

$$y_1 = g_1(u_1, u_2, u_3) \quad (6A).$$

$$y_2 = g_2(u_1, u_2, u_3) \quad (6B).$$

where, representations $g_1$ and $g_2$ show functions including the positive parameters $p_1$, $p_2$, $p_3$ and $p_4$. If the functions $g_1$ and $g_2$ are accurately obtained, an input vector U is so calculated as that the output vector Y is coincident with a target vector $Y_d$ representing the target density of the current. However, since the parameters $p_1$-$p_4$ depend on various conditions of the electrophotographic process such as power source voltage, temperature and humidity, it is very difficult to accurately obtain the functions $g_1$ and $g_2$ including these parameters $p_1$-$p_4$.

In the present invention, a boundary parameter Q including the parameters $p_1$-$p_4$ is defined first. Therefore, the midpoint value $y_1$ of the density curve M is made to be coincident with the midpoint value $y_{1\text{-}d}$ of the density curve T, and the gradient $y_2$ of the density curve M is also made to be coincident with the gradient $y_{2-d}$ of the density curve T by adequately controlling the electro-photographic process by using the boundary parameter Q.

The gradient of the density curve M is variable by changing the input voltage $u_1$ and the charge voltage $u_2$. In general, when the input voltage $u_1$ is increased, the density of the toner image is decreased. Then the rate of change of the low output density $D_{OUT.L}$ is larger than that of the high output density $D_{OUT.H}$.

On the other hand, when the charge voltage $U_2$ is increased, the density of the toner image is increased. Then, the rate of change of the low output density $D_{OUT.L}$ is smaller than that of the high output density $D_{OUT.H}$. Consequently, the gradient of the density curve M is adjustable by an adequate combination of an input voltage $u_1$ and a charge voltage $u_2$.

CONTROL CIRCUIT CONFIGURATION

Figure 3:
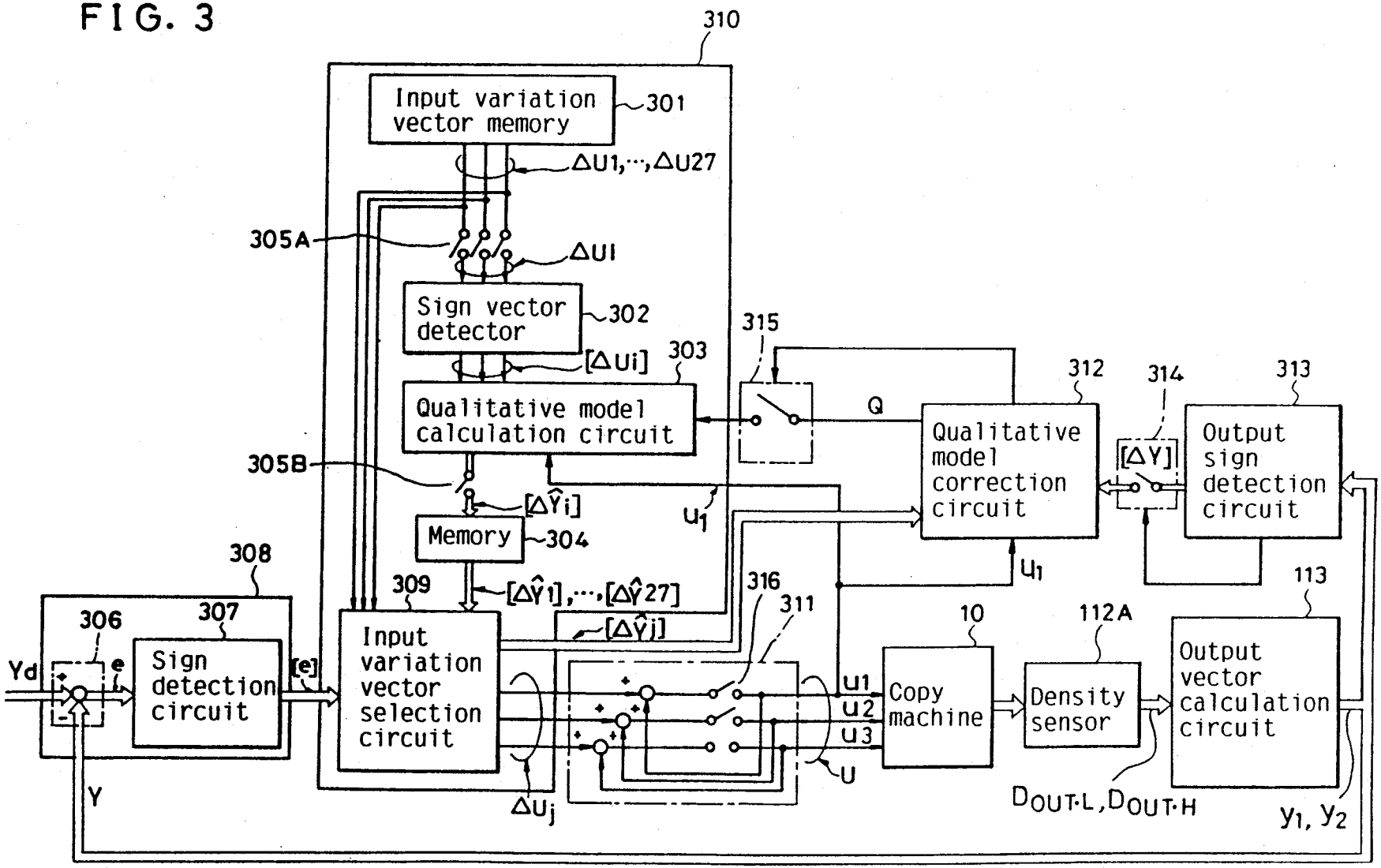
FIG. 3 is a circuit block diagram of a first embodiment of the adaptive control electrophotographic apparatus.

FIG. 3 is a circuit block diagram of a first embodiment of the adaptive control system in accordance with the present invention. Referring to FIG. 3, the adaptive control system of the first embodiment comprises; an input variation vector determining circuit 310 for determining an input variation vector; an input vector renewal circuit 311 for renewing the input vector U which is inputted to the copy machine 10; an output sign detection circuit 313 for detecting a sign which represents increase or decrease of variation of a copy density of the copy machine 105 on the basis of the output of a density sensor 112A (increase of variation is represented by "+" and decrease of variation is represented by "−"); an output vector calculation circuit 113; a qualitative model correction circuit 312; and an error sign detection circuit 308. Output vector $Y=(y_1, y_2)$ which is output from the output vector calculation circuit 113 is applied to an output sign detection circuit 313 and an error sign detection circuit 308.

The input variation vector determination circuit 310 comprises the following seven elements:

(1) input variation vector memory 301:

The input variation vector memory 301 stores predetermined twenty-seven input variation vectors $\Delta U_1 \ldots \Delta U_{27}$. The number of the input variation vector $\Delta U_i$ is given by ($3^3$). The numeral "3" represents the number of signs "+", "−" and "0", and the exponent "3" of the power is equal to the number of the components of the input variation vector $\Delta U_i$. The input variation vector $\Delta U_i$ comprises three data ($\Delta u_1$, $\Delta u_2$, $\Delta u_3$), and each data is either one of a positive value, a negative value or zero, for example ($\Delta u_1$, 0, 0), or (0, $-\Delta u_2$, $\Delta u_3$). The positive value represents increase of a voltage and the negative value represents decrease of the voltage. "Zero" represents an unchanged value. The data $\Delta u_1$, $\Delta u_2$ and $\Delta u_3$ represent small voltages which are added to the input voltage $u_1$ of the illumination light source 103, the charge voltage $u_2$ of the charging unit 102 and the developer bias voltage $u_3$ of the developing unit 105, respectively.

(2) Switch 305A:

The switch 305A is closed to input the data of the input variation vector memory 301 to a sign vector detector 302.

(3) Sign vector detector 302:

The sign vector detector 302 receives an input variation vector $\Delta U_i$ from the input variation vector memory 301, and outputs a sign vector $[\Delta U_i]$ which represents sign (+, − or 0) of each data. Hereinafter, a letter put in brackets [ ] represents sign "+", "−" or "0" of the data represented by the letter. For example, when an input variation vector $\Delta U_i$ (=0, $\Delta u_2$, $\Delta u_3$) is inputted, a sign vector $[\Delta U_i]$ (=0, −, +) is output.

(4) Qualitative model calculation circuit 303;

The qualitative model calculation circuit 303 comprises a calculator for predicting a sign of the output "y" which represents a midpoint value $y_1$, or a gradient $y_2$ on the basis of the sign vector $[\Delta U_i]$ output from the sign vector detector 302. The calculation is performed in compliance with a predetermined qualitative model, and as a result, a predictive sign data $[\Delta \hat{Y}_i]$ is output. Hereinafter the " " attached on a letter represents predictive data of the data represented by the letter. The predictive sign data $[\Delta \hat{Y}_i]$ represents a sign for representing a predictive variation direction of the output "y", and comprises one of increase prediction "+", decrease prediction "−", unchanged prediction "0" and impossibility of prediction "?".

(5) Switch 305B:

The switch 305B is connected between the sign vector detector 302 and a memory 304 and is closed to input the output data of the qualitative model calculation circuit 303 to a memory 304.

(6) Memory 304:

The predictive sign data $[\Delta \hat{Y}_i]$ output from the qualitative model calculation circuit 303 is memorized in the memory 304 through the switch 305B. In normal operation, twenty-seven predictive sign data $[\Delta \hat{Y}_1]$, $[\Delta \hat{Y}_2] \ldots$, $[\Delta \hat{Y}_{27}]$ are memorized in the memory 304.

(7) Input variation vector selection circuit 309:

The input variation vector selection circuit 309 receives a predictive sign data $[\Delta \hat{Y}_i]$ from the memory 304 and an input variation vector $\Delta U_i$ from the input variation vector memory 301. The one predictive sign data $[\Delta \hat{Y}_j]$, which is coincident with a sign [e] of the value of an error inputted from an error sign detection circuit 308 (which is described hereafter), is selected from entire predictive sign data $[\Delta \hat{Y}_1]$-$[\Delta \hat{Y}_{27}]$. The selected predictive sign data $[\Delta Y_j]$ is applied to the qualitative model correction circuit 312.

The adaptive control system further comprises the error sign detection circuit 308, an input vector renewal circuit 311 and a qualitative model correction circuit 312.

Error sign detection circuit 308:

The error sign detection circuit 308 has an error calculation circuit 306 for evaluating a difference between an aimed value "$Y_d$" and the detected value "Y" of the density sensor 112A, and the error "e" calculated thereby is inputted to a sign detection circuit 307. Then a sign [e] of the value of the error "e" is detected by a sign detection circuit 307, and the sign [e] is inputted to the input variation vector selection circuit 309. The sign [e] has one of data of the signs "+", "−" and "0". Namely, the sign [e] has information to increase or to decrease the output "Y" so as to approach a desired output "$Y_d$", or to maintain the present output.

Input vector renewal circuit 311:

The input variation vector $\Delta U_j$ output from the input variation vector selection circuit 309 is added to the present input U by the input vector renewal circuit 311, and a new input U is applied to the copy machine 10. A switch 316 is opened during the above-mentioned addition.

Density sensor 112A:

Density in the copy machine 10 is detected by the density sensor 112A. The output of the density sensor 112A is applied to an output vector calculation circuit 113.

Output vector calculation circuit 113:

In the output vector calculation circuit 113, calculations of the relations (4) and (5) are carried out, and the midpoint value $y_1$ and the gradient $y_2$ are output to the error sign detection circuit 308 and the output sign detection circuit 313.

Figure 4:
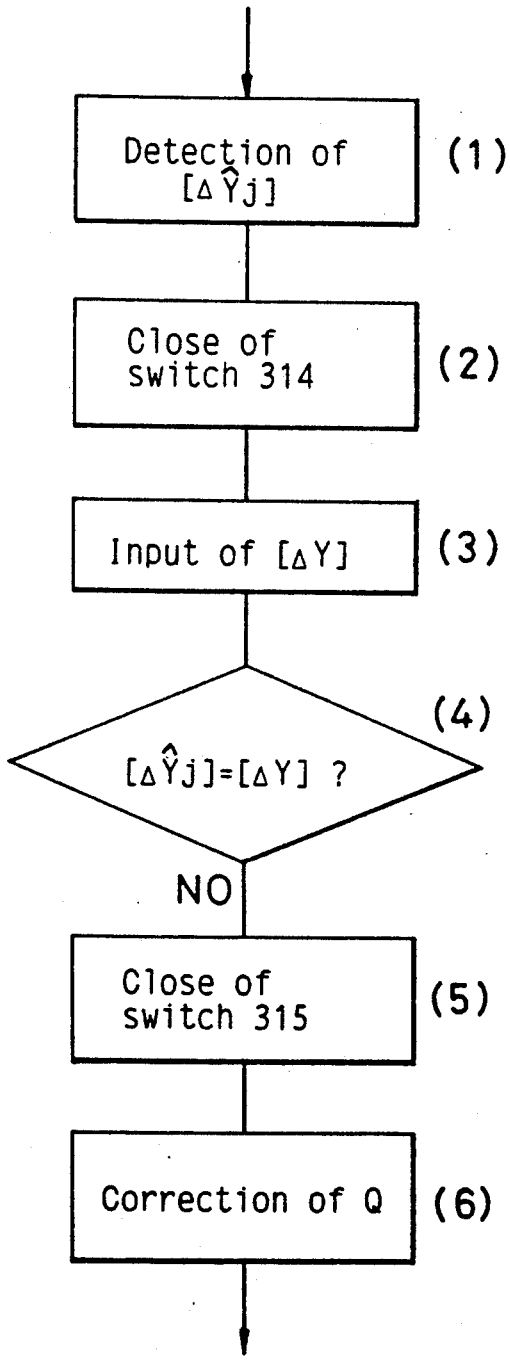
FIG. 4 is a flow chart of operation of a qualitative model correction circuit and an output sign detection circuit of the first embodiment.

Qualitative model correction circuit 312:

The qualitative model correction circuit 312 receives the input U and the predictive sign data $[\Delta Y_j]$. A sign variation vector $[\Delta Y]$ which represents variation of a density is detected by the output sign detection circuit 313, and thereby, a switch 314 is closed (Steps 1 and 2 of the flow chart shown in FIG. 4). Then the sign variation vector $[\Delta \hat{Y}]$ is inputted to the qualitative model correction circuit 312 (Step 3).

In the qualitative model correction circuit 312, the sign variation vector $[\Delta Y]$ is compared with the predictive sign data $[\Delta \hat{Y}_j]$ (Step 4), and when both the sign variation vector $[\Delta \hat{Y}]$ and the predictive sign data $[\Delta Y_j]$ are not equal, a switch 315 is closed. Consequently, correction output Q is inputted to the qualitative model calculation circuit 303 (Steps 5 and 6), and thereby the qualitative model is corrected.

Qualitative model

The qualitative model is elucidated hereafter.

A qualitative relation between the midpoint value $y_1$ (see relation (4)), the gradient $y_2$ (see relation (5)) and the voltages $u_1$, $u_2$ and $u_3$ are represented by relations 7A and 7B by using functions $g_1$ and $g_2$.

$$\begin{aligned} y_1 &= g_1(u_1, u_2, u_3) \\ &= \frac{p_4}{2}\{(\sqrt{p_2u_2} - p_3 \cdot p_1 \cdot 10^{-DIN\cdot H} \cdot u_1)^2 + (\sqrt{p_2u_2} - p_3 \cdot p_1 \cdot 10^{-DIN\cdot L} \cdot u_1)^2 - 2u_3\}. \end{aligned} \tag{7A}$$

$$\begin{aligned} y_2 &= g_2(u_1, u_2, u_3) \\ &= \frac{p_4}{(D_{IN\cdot H} - D_{IN\cdot L})}\{(\sqrt{p_2u_2} - p_3 \cdot p_1 \cdot 10^{-DIN\cdot H} \cdot u_1)^2 - (\sqrt{p_2u_2} - p_3 \cdot p_1 \cdot 10^{-DIN\cdot L} \cdot u_1)^2\}. \end{aligned} \tag{7B}$$

The midpoint value $y_1$ is partially differentiated by the voltage $u_1$ as shown by equation (8), $$\frac{\partial y_1}{\partial u_1} = -p_1p_3p_4\{\sqrt{V_H} \cdot 10^{-DIN\cdot H} + \sqrt{V_L} \cdot 10^{-DIN\cdot L}\} < 0, \tag{8}$$

where, $V_H$: surface potential at a part of the drum 101 at which the reflected light from the first reference mark 107 is applied, $V_L$: surface potential at a part of the drum 101 at which the reflected light from the second reference mark 108 is applied.

The midpoint value $y_1$ is partially differentiated by the voltage $u_2$ as shown by equation (9), $$\frac{\partial y_1}{\partial u_2} = \frac{\sqrt{p_2} \cdot p_4}{2\sqrt{u_2}}(\sqrt{V_H} + \sqrt{V_L}) > 0. \tag{9}$$

The midpoint value $y_1$ is partially differentiated by the voltage $u_3$ as shown by equation (10), $$\frac{\partial y_1}{\partial u_3} = -p_4 < 0. \tag{10}$$

The gradient $y_2$ is partially differentiated by the voltage $u_1$ as shown by equation (11), $$\frac{\partial y_2}{\partial u_1} = \frac{2p_1p_3p_4(10^{-DIN\cdot L} - 10^{-DIN\cdot H})}{(D_{IN\cdot H} - D_{IN\cdot L})} \times \{\sqrt{p_2u_2} - p_1p_3u_1(10^{-DIN\cdot H} + 10^{-DIN\cdot L})\}. \tag{11}$$

The term $\{\sqrt{p_2u_2} - p_1p_3u_1(10^{-DIN\cdot H} + 10^{-DIN\cdot L})\}$ of the right side is considered in three cases of positive value (>0), (=0) or negative value (<0) as shown by relations (11A−), (11B) and (11C), $$\sqrt{p_2u_2} - p_1p_3u_1(10^{-DIN\cdot H} + 10^{-DIN\cdot L}) > 0. \tag{11A}$$

$$\sqrt{p_2u_2} - p_1p_3u_1(10^{-DIN\cdot H} + 10^{-DIN\cdot L}) = 0. \tag{11B}$$

$$\sqrt{p_2u_2} - p_1p_3u_1(10^{-DIN\cdot H} + 10^{-DIN\cdot L}) < 0. \tag{11C}$$

Each relation (11A), (11B) or (11C) is solved with respect to "$u_1$" as shown by the relation (11D), (11E) or (11F), $$\frac{\sqrt{p_2u_2}}{p_1p_3(10^{-DIN\cdot H} + 10^{-DIN\cdot L})} > u_1, \tag{11D}$$

$$\frac{\sqrt{p_2u_2}}{p_1p_3(10^{-DIN\cdot H} + 10^{-DIN\cdot L})} = u_1, \tag{11E}$$

$$\frac{\sqrt{p_2u_2}}{p_1p_3(10^{-DIN\cdot H} + 10^{-DIN\cdot L})} < u_1. \tag{11F}$$

The left sides of the relations (11D), (11E) and (11F) are represented by "Q" which is called a "boundary parameter", as follows:

$$Q = \frac{\sqrt{p_2u_2}}{p_1p_3(10^{-DIN\cdot H} + 10^{-DIN\cdot L})}. \tag{11G}$$

Consequently, the voltage $u_1$ is represented by the boundary parameter Q as follows:

$$\left.\begin{aligned} u_1 &> Q \\ u_1 &= Q \\ u_1 &< Q \end{aligned}\right\}. \tag{11H}$$

Subsequently, the gradient $y_2$ is partially differentiated by the voltage $u_2$ as shown by equation (12), $$\frac{\partial y_2}{\partial u_2} = \frac{\sqrt{p_2} \cdot p_4}{(D_{IN:H} - D_{IN:L})\sqrt{u_2}}(\sqrt{V_H} - \sqrt{V_L}) > 0. \quad (12)$$

Finally, the gradient $y_2$ is partially differentiated by the voltage $u_3$ as shown by equation (13), $$\frac{\partial y_2}{\partial u_3} = 0. \quad (13)$$

The relation between the predictive sign data $[\Delta\hat{Y}]=([\Delta y_1], [\Delta y_2])$ and input voltage sign data $[\Delta U_j]=([\Delta u_1], [\Delta u_2], [\Delta u_3])$ is represented by relations (14) and (15), $$[\Delta\hat{y}1] = -[\Delta u_1] + [\Delta u_2] - [\Delta u_3], \quad (14)$$

$$[\Delta\hat{y}2] = \left.\begin{array}{ll} [\Delta u_1] + [\Delta u_2] & (u_1 < Q) \\ [\Delta u_2] & (u_1 = Q) \\ -[\Delta u_1] + [\Delta u_2] & (u_1 > Q) \end{array}\right\}. \quad (15)$$

$[\Delta\hat{y}_1]$: predictive sign data of midpoint value $y_1$, $[\Delta\hat{y}_2]$: predictive sign data of gradient $y_2$.

The relations (14) and (15) are shown in Table 1. The region number designates the region of the difference $(u_1-Q)$.

TABLE 1

| Region number | $[u_1 - Q]$ | Predictive sign data $[\Delta\hat{y}] = ([\Delta\hat{y}_1], [\Delta\hat{y}_2])$ |
|---|---|---|
| 1 | + | $[\Delta\hat{y}_1] = -[\Delta u_1] + [\Delta u_2] - [\Delta u_3]$<br>$[\Delta\hat{y}_2] = -[\Delta u_1] + [\Delta u_2]$ |
| 2 | 0 | $[\Delta\hat{y}_1] = -[\Delta u_1] + [\Delta u_2] - [\Delta u_3]$<br>$[\Delta\hat{y}_2] = [\Delta u_2]$ |
| 3 | − | $[\Delta\hat{y}_1] = -[\Delta u_1] + [\Delta u_2] - [\Delta u_3]$<br>$[\Delta\hat{y}_2] = [\Delta u_1] + [\Delta u_2]$ |

Referring to Table 1, region numbers 1, 2 and 3 show regions which are divided to three parts in compliance with a difference between input vector U $(=u_1, u_2, u_3)$ and a boundary parameter Q. A "boundary function sign" in the table 1 is decided as follows: for example, the boundary function sign $[u_1-Q]$ is positive (+) in the region number 1, because of "$u_1-Q>0$". In a similar manner, in the region number 2, the boundary function sign $[u_1-Q]$ is zero because of "$u_1-Q=0$".

Moreover, the predictive sign data $[\Delta\hat{Y}]$ is derived as follows: for example, in the region number (1), the predictive sign data $[\Delta\hat{Y}_i]$ is represented by a set of two minus signs (−, −) with respect to a sign vector $[\Delta U_{1'}]$ (=(+, 0, −)). In the region number (2), the predictive sign data $[\Delta\hat{Y}_i]$ is represented by a set of two plus signs (+, +) with respect to a sign vector $[\Delta U_i]$ (=(−, +, −)). Consequently, $$\begin{aligned}[\Delta\hat{Y}_i] &= (-[\Delta u_1] + [\Delta u_2] - [\Delta u_3], [\Delta u_2]) \\ &= (-\text{"}-\text{"} + \text{"}+\text{"} - \text{"}-\text{"}, +).\end{aligned}$$

Moreover, a predictive sign data $[\Delta\hat{Y}_i]$ has no conformed value with respect to a sign vector $[\Delta U_i]=(+, +, -)$ as shown by relation (16), $$\begin{aligned}[\Delta\hat{Y}_i] &= (-[\Delta u_1] + [\Delta u_2] - [\Delta u_3], [\Delta u_2]) \\ &= (-\text{"}+\text{"} + \text{"}+\text{"} - \text{"}-\text{"}, +) = (?, +),\end{aligned} \quad (16)$$

The output of the qualitative model correction circuit 312 includes the boundary parameter Q which is determined by the parameters $p_1$, $p_2$ and $p_3$. Sine measurement of these parameters $p_1$, $p_2$ and $p_3$ is very difficult, the boundary parameter Q cannot be accurately estimated. Therefore the prediction based on Table 1 is not always correct. If the prediction is not correct, a sign data $[\Delta Y]$ of the actual output detected by the output sign detection circuit 313 is noncoincident with the predictive sign data $[\Delta\hat{Y}]$ output from the input variation vector selection circuit 309. In the above-mentioned case, the boundary parameter Q of a qualitative model in the qualitative model calculation circuit 303 is modified, because it seems that the qualitative model which is used in the qualitative model calculation circuit 303 is inadequate.

An example of the operation of modification which are applied with an actual values is described hereafter.

It is assumed that the voltages $u_1$, $u_2$, $u_3$ in an electrophotographic apparatus are 65 V, 700 V, 400 V, respectively, and boundary parameter Q is 70 V. According to Table 1, $$[u_1-Q]=[65-70]=[-5]=\text{"}-\text{"} \quad (17).$$

Accordingly, the region number (3) is selected for use. Then, if the following input variation vector $\Delta U_i$ is applied to the sign vector detector 302;

$$\Delta U_i=(+\Delta u_1, 0, +\Delta u_3)=(+0.5\text{ V}, 0, +0.5\text{ V}) \quad (18),$$

the predictive sign data $[\Delta\hat{Y}]$ is calculated by the Table 1 as follows:

$$\begin{aligned}[\Delta Y] &= (-[\Delta u_1] + [\Delta u_2] - [\Delta u_3], [\Delta u_1] + [\Delta u_2]) \\ &= (-[+0.5] + [0] - [+0.5], [+0.5] + [0]) \\ &= (-, +).\end{aligned} \quad (19)$$

After operation of the electrophotographic apparatus to which the above-mentioned input variation vector $\Delta U_i$ is inputted, if the output sign data $[\Delta Y]$ is "(−, −)", it seems that selection of the region number is wrong. Accordingly, in the Table 1, a region number (1) is selected in a manner that the predictive sign data $[\Delta\hat{Y}]$ becomes "(−, −)".

Subsequently, a boundary parameter Q which matches with the boundary function of region number (1) is calculated as follows:

$$[u_1-Q']=[65-Q']=\text{"}+\text{"}>0 \quad (20).$$

In order to fulfill relation (20), the value of "Q'" is selected as follows:

$$Q'=65-\epsilon \quad (21),$$

where, "$\epsilon$" is a positive real number.

Figure 5:
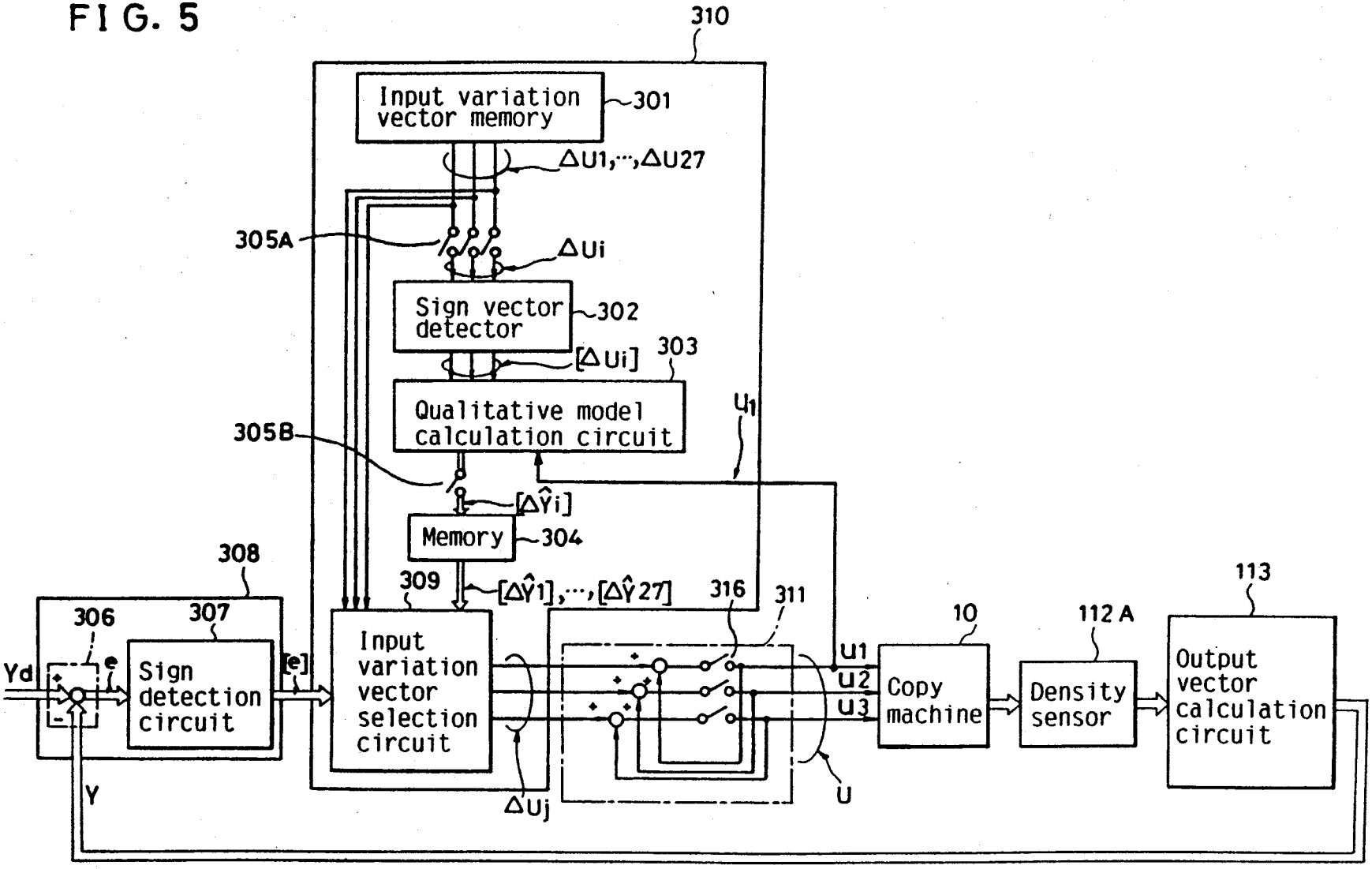
FIG. 5 is a circuit block diagram of a second embodiment of the adaptive control system in accordance with the present invention.

On the other hand, when the sign data $[\Delta Y]$ is "(−, +)", the predictive sign data $[\Delta\hat{Y}]$ is coincident with the sign data $[\Delta Y]$. Therefore, boundary parameter Q is not modified. Moreover, in the event that the input voltage $u_1$ is very low in comparison with a boundary parameter Q, namely, that in Table 1, sign $[u_1-Q]$ is "−" (region number (3)), the boundary parameter is not modified. Therefore, the qualitative model correction circuit 312, output sign detection circuit 313 and switches 314 and 315 are unnecessary. An adaptive control electrophotographic apparatus which has none of these circuits and switches is shown in FIG. 5 as a second embodiment.

In FIG. 1, a density sensor 112B may be located adjacent to a transfer belt 120, and the density of the toner image transferred on a copy paper 121 placed on the transfer belt 120 is detected thereby. In the example, an output vector $Y(=y_1, y_2)$ is obtained on the basis of the toner images transferred on the transfer belt 120. Therefore, optimum control is realizable in an actual copy machine using a paper or the like to be transferred.

In the event that high precision is not required in density control of the electrophotographic apparatus, a required density characteristic is realizable by changing the light source input voltage $u_1$ and change voltage $u_2$. Accordingly, the input variation vector determination circuit 310 is simplified.

Table 2 is a qualitative model list of actual sign vectors $[\Delta U_j]$ which are output from the input variation vector determination circuit 310 with respect to the sign [e] of an error "e" detected by the error sign detection circuit 308.

TABLE 2

| Region number | $[u_1-Q]$ | [e] $[y_{1-d}-y_1]$ | [e] $[y_{2-d}-y_2]$ | $[\Delta U_1]$ |
|---|---|---|---|---|
| 1 | + | + | + | (−, +, −) |
| | | + | 0 | (0, 0, −) |
| | | + | − | (+, −, −) |
| | | 0 | + | (−, +, 0) |
| | | 0 | 0 | (0, 0, 0) |
| | | 0 | − | (+, −, 0) |
| | | − | + | (−, +, +) |
| | | − | 0 | (0, 0, +) |
| | | − | − | (+, −, +) |
| 2 | 0 | + | + | (0, +, −) |
| | | + | 0 | (0, 0, −) |
| | | + | − | (0, −, −) |
| | | 0 | + | (0, +, 0) |
| | | 0 | 0 | (0, 0, 0) |
| | | 0 | − | (0, −, 0) |
| | | − | + | (0, +, +) |
| | | − | 0 | (0, 0, +) |
| | | − | − | (0, −, +) |
| 3 | − | + | + | (+, +, −) |
| | | + | 0 | (0, 0, −) |
| | | + | − | (−, −, −) |
| | | 0 | + | (+, +, 0) |
| | | 0 | 0 | (0, 0, 0) |
| | | 0 | − | (−, −, 0) |
| | | − | + | (+, +, +) |
| | | − | 0 | (0, 0, +) |
| | | − | − | (−, −, +) |

In the table 2, nine combinations of the input signs [e] and the output sign vectors $[\Delta U_j]$ in each region, which are particularly useful in actual application of the adaptive control to the copy machine, are selected from twenty-seven combinations in each region. The combinations listed on the table 2 are picked up on the basis of a predetermined software, and hence an efficient adaptive control is realizable.

Figure 6:
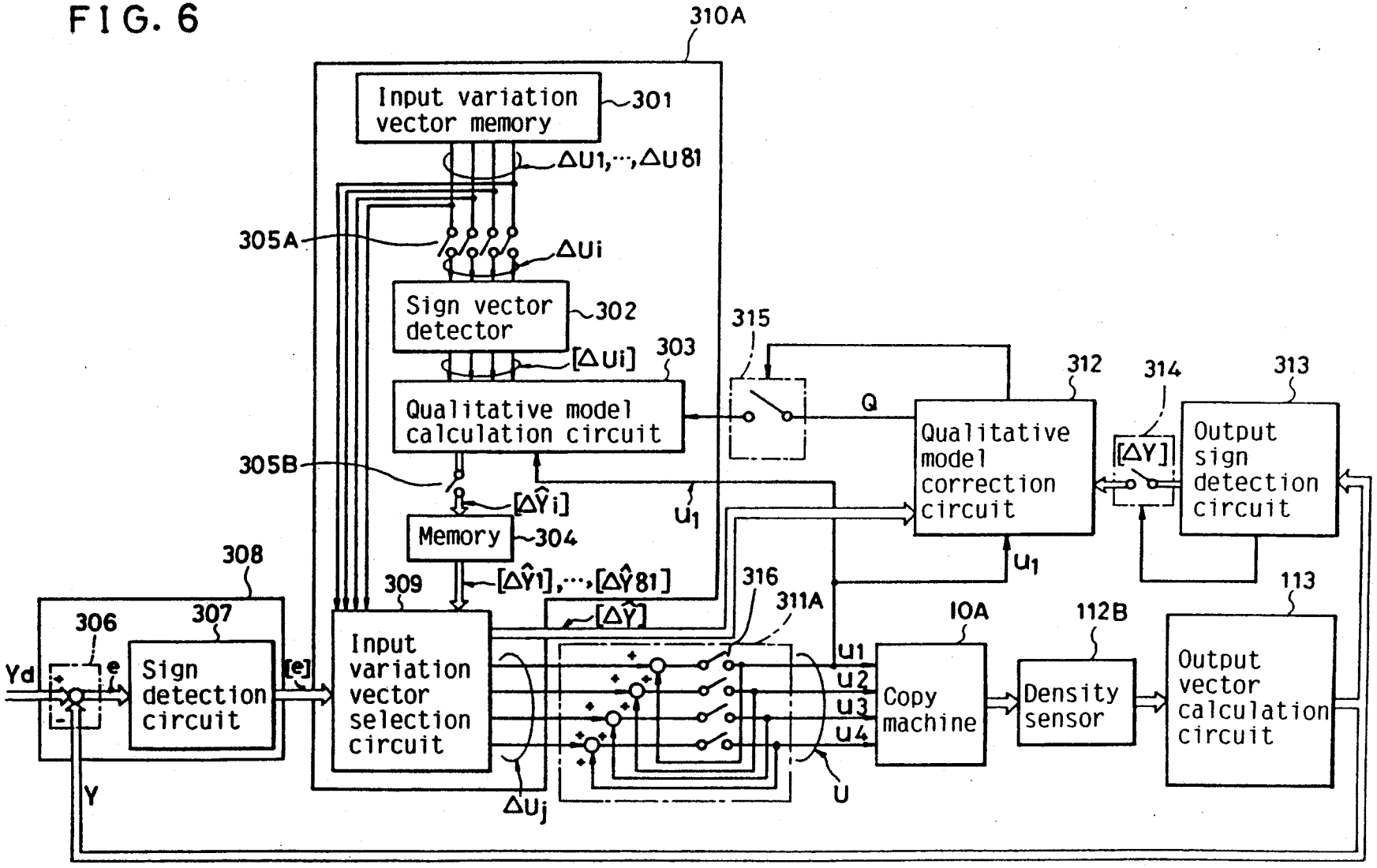
FIG. 6 is a circuit block diagram of a third embodiment of an electrophotographic apparatus in accordance with the present invention.

FIG. 6 is a circuit block diagram of a third embodiment of the electrophotographic apparatus in accordance with the present invention.

In the third embodiment, a transfer voltage $u_4$ is applied to a transfer belt charge unit 115 of the transfer belt 120 for transferring the toner image of the drum 101 onto a copy paper rested on the transfer belt 120, for example. A density sensor 112B is positioned adjacent to the transfer member 120 and detects the toner image of the reference mark transferred on the copy paper.

In the third embodiment, input variation vectors $\Delta U_1 \ldots \Delta U_{81}$ of the light source voltage $u_1$, charge voltage $u_2$, developer bias voltage $u_3$ and transfer voltage $u_4$ are processed in an input variation vector determination circuit 310A, and these are output to a copy machine 10A through an input vector renewal circuit 311A. Remaining configuration and operation of the electrophotographic apparatus are similar to that of the first embodiment. According to the third embodiment, since the transfer voltage $u_4$ is controlled on the basis of the qualitative model, even if the condition of a copy paper on which the toner image is transferred is changed because of temperature, humidity or change in the quality of a copy paper, the copy of a document in a better quality is realizable.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. An adaptive control electrophotographic apparatus comprising:

charging means for charging a photoconductive substance of the electrophotographic apparatus with a predetermined voltage, exposing means for forming a latent image of a reference mark on said photoconductive substance including light emitting means for emitting light which is reflected from said reference mark to form said latent image, said light emitting means being activated by an input voltage, developer means for generating a visible image of said latent image on said photoconductive substance by supplying toner which is biased by a predetermined developer bias voltage, density sensor means for detecting a density of said visible image of said reference mark formed on said photoconductive substance, input variation vector generating means for generating a plurality of input variation vectors for varying said predetermined voltage, said input voltage and said developer bias voltage, qualitative model calculation means for outputting predictive sign data by applying a predetermined qualitative model to said input variation vectors, said predictive sign data predicting variations in said detected visible image density, error sign detection means for detecting a sign of a difference between a target visible image density and the detected visible image density, an input variation vector selection circuit for selecting an input variation vector on the basis of output from said error sign detection means and said predictive sign data, output sign detecting means for detecting a sign representing a variation of said detected visible image density, input vector renewal means for adding said selected input variation vector to said predetermined voltage, said input voltage and said developer bias voltage, and qualitative model correction means for correcting said qualitative model on the basis of output from said input vector renewal means and output from said output sign detecting means.

2. An adaptive control electrophotographic apparatus comprising:

charging means for charging a photoconductive substance of the electrophotographic apparatus with a predetermined voltage, exposing means for forming a latent image of a reference mark on said photoconductive substance including light emitting means for emitting light which is reflected from said reference mark to form said latent image, said light emitting means being activated by an input voltage, developer means for generating a visible image of said latent image on said photoconductive substance by using toner which is biased by a predetermined developer bias voltage, density sensor means for detecting a density of said visible image of said reference mark formed on said photoconductive substance, input variation vector generating means for generating a plurality of input variation vectors for varying said predetermined voltage, said input voltage and said developer bias voltage, qualitative model calculation means for outputting predictive sign data by applying a predetermined qualitative model to said input variation vectors, said predictive sign data predicting variations in said detected visible image density, error sign detection means for detecting a sign of a difference between a target visible image density and the detected visible image density, an input variation vector selection circuit for selecting an input variation vector on the basis of output from said error sign detection means and said predictive sign data, and input vector renewal means for adding said selected input variation vector to said predetermined voltage, said input voltage and said developer bias voltage.

3. An adaptive control electrophotographic apparatus in accordance with claim 1 or 2 further comprises:

transfer means for transferring said visible image to a transfer member, and second density sensor means for detecting density of said visible image of said reference mark formed on said transfer member.

4. An adaptive control electrophotographic apparatus comprising:

charging means for charging a photoconductive substance of the electrophotographic apparatus with a predetermined voltage, exposing means for forming a latent image of a reference mark on said photoconductive substance including light emitting means for emitting light which is reflected from said reference mark to form said latent image, said light emitting means being activated by an input voltage, developer means for generating a visible image of said latent image on said photoconductive substance by supplying toner which is biased by a predetermined developer bias voltage, a transfer member;

transfer means applying a transfer voltage to said transfer member for transferring said visible image from said photoconductive substance to said transfer member, density sensor means for detecting a density of said visible image of said reference mark formed on said transfer member, input variation vector generating means for generating a plurality of input variation vectors for varying said predetermined voltage, said input voltage, said developer bias voltage and said transfer voltage, qualitative model calculation means for outputting predictive sign data by applying a predetermined qualitative model to said input variation vectors, said predictive sign data predicting variations in said detected visible image density, error sign detection means for detecting a sign of a difference between a target visible image density and the detected visible image density, an input variation vector selection circuit for selecting an input variation vector on the basis of output from said error sign detection means and said predictive sign data, output sign detecting means for detecting a sign representing a variation of said detected visible image density, input vector renewal means for adding said selected input variation to said predetermined voltage, said input voltage, said developer bias voltage and said transfer voltage, and qualitative model correction means for correcting said qualitative model on the basis of output from input vector renewal means and output from said output sign detecting means.

5. An adaptive control electrophotographic apparatus in accordance with claim 1, 2, 3, or 4 wherein said reference mark comprises a high density mark and a low density mark.

6. An adaptive control electrophotographic apparatus in accordance with claim 1, 2, 3, or 4 wherein said reference mark is located outward from a manuscript to be copied.

* * * * *